United States Patent [19]

Okuda et al.

[11] 4,400,334

[45] Aug. 23, 1983

[54] APPARATUS FOR MAKING HEARTH OF KILN UNDER VIBRATION

[75] Inventors: Shigeru Okuda, Bizen; Masashi Mori, Okayama; Masahiro Hayase, Bizen, all of Japan

[73] Assignee: Shinagawa Refractories Co., Ltd., Tokyo, Japan

[21] Appl. No.: 311,767

[22] Filed: Oct. 15, 1981

Related U.S. Application Data

[62] Division of Ser. No. 149,898, May 15, 1980, abandoned.

[30] Foreign Application Priority Data

Aug. 22, 1979 [JP] Japan ..... 54-114569

[51] Int. Cl.[3] ..... F27D 1/16

[52] U.S. Cl. ..... 264/30; 264/71

[58] Field of Search ..... 264/30, 71

[56] References Cited

U.S. PATENT DOCUMENTS

| | | | |
|---|---|---|---|
| 3,467,738 | 9/1969 | Pyzel | 264/30 |
| 3,963,815 | 6/1976 | Ezaki | 264/30 |
| 4,279,844 | 7/1981 | Danjyo | 264/30 |

*Primary Examiner*—Thomas P. Pavelko

*Attorney, Agent, or Firm*—Larson and Taylor

[57] ABSTRACT

An apparatus and method for making a hearth of kiln under vibration comprising mounting vibrating mechanisms to a pressurizing plate in which the area of the pressurizing surface is in the range 0.5–5 $m^2$, and said vibrating mechanisms are mounted to the pressurizing plate directly or through a frame.

5 Claims, 4 Drawing Figures

APPARATUS FOR MAKING HEARTH OF KILN UNDER VIBRATION

This is a division of the application Ser. No. 149,898 filed May 15, 1980, now abandoned.

This invention relates to a method for making with plastic material the hearth of a kiln, particularly of an electric furnace for making steel. The object of the invention is to provide an apparatus and method in which dry, stamping material can be quickly and with high-density applied under vibration by means of remote control.

Generally, the hearth of an electric furnace is lined, in the interior of the shell of its curved bottom, with fireclay brick. Further, on the lined brick there is stamped in a thickness range of about 300–500 mm a magnesia stamping material of magnesia clinker regulated in particle size and to which is added 3–5% by weight of brine or water glass as a binder. As to the devices used when making the hearth, however, there are mentioned only various air rammers and some wooden frames. Generally, many workers enter into the furnace, and with air rammers in hand they stamp in the layer form in zigzag direction from a stamping material previously charged. This operation forms a thickness of about 150 mm. As necessary, they repeat said operation many times thereby to complete to a desired thickness. However, such operation has the following disadvantages:

(1) Since about 2–5% by weight of water is required for the conventional stamping operation by air rammers, it takes a long time before the stamped material of each layer is dried whereby the heat energy is greatly lost. Moreover, in a furnace using magnesia stamping material, the magnesia clinker is slaked to shorten the life of the furnace. (2) Besides requiring a lot of laborers for carrying out the operation, the stamped material in the layer form is likely to be released and damaged in use because the material is stamped in comparatively thin layers.

(3) If engaged in the working for a longer period of time, there is a fear of causing an occupational disease in the laborers due to vibrations.

As the operational conditions recently have become severe, the enduring life of hearths in particular are being shortened so that studies have been made for the purpose of prolonging the life. In this respect, a dry stamping material of magnesia type has recently been developed. However, a compacting device having an internal vibrator of high vibrating frequency is the sole apparatus employed in the operation so that the operation requires a longer time. In addition, the layers are released whereby the properties of the stamping material cannot be sufficiently utilized.

The present invention has been made to eliminate all these disadvantages. It is characterized in that the known vibrating mechanism is mounted, directly or through a frame, to a pressurizing plate of substantially sector shape. Said plate is made of comparatively thin steel. The present apparatus is applicable to any type of electric furnace and is capable of making the hearth quickly and uniformly under vibration with the dry stanping material.

The invention will now be described in detail, by way of example, with reference to the accompanying drawings in which.

Figure 1:
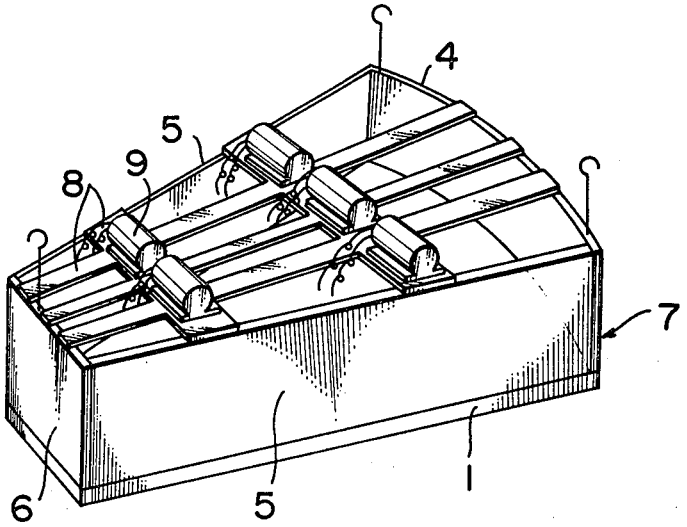
FIG. 1 is a perspective view when observed from outside, showing an example of the present apparatus.

FIG. 1 shows an appropriate example of the invention, in which reference numeral 1 designates a pressurizing plate 9 the lower surface of which is comparatively smooth and which is of a sector shape. Said plate 1 is made of a steel plate or moulding plate in which the outer side portion is arc shaped (of about 2.2 m in arc length) and is about the same radius (for example 2.6 m) as the hearth radius of an electric furnace. Both the sides portions are straight having about the same length as the hearth radius of said furnace. The inner side portion (central portion) is cut in a straight line (approximately 0.8 m). Reference 4 is an outside steel panel which is curved at the same ratio as the outside portion of said pressurizing plate 1. Reference 5, is a pair of flat side panels radially directed relative to the hearth. Numeral 6 shows an inside panel. Said outside panel 4, side panels 5 and inside panel 6 constitute a circumferential portion 7. Bridged upon circumferential portion 7 are steel members 8 for mounting vibrating mechanisms 9. These elements constitute a frame.

Figure 2:
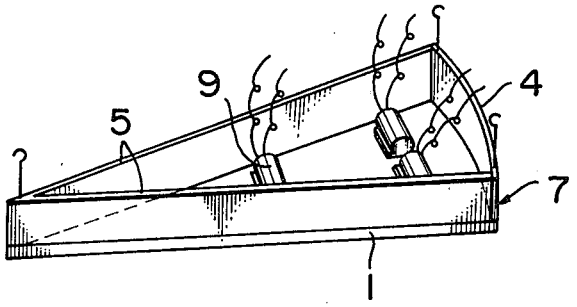
FIG. 2 is a perspective view of an example in which a vibrating mechanism is attached directly to the pressurizing plate and which has a circumferential portion.
Figure 3:
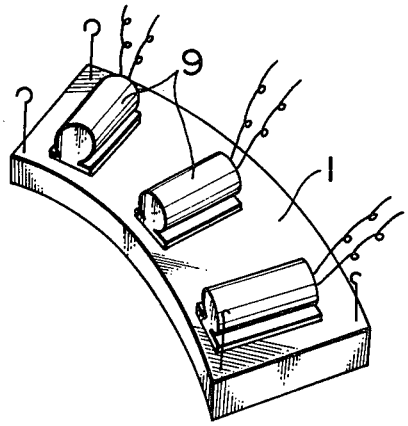
FIG. 3 is a perspective view when observed from outside, of an example having no circumferential portion.
Figure 4:
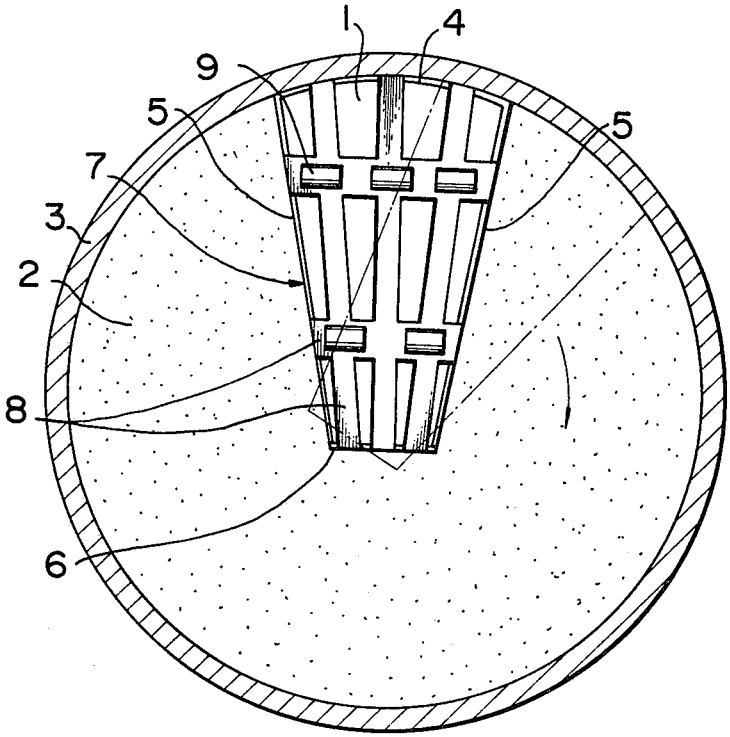
FIG. 4 is an explanatory view of the operational method in constructing a hearth of an electric furnace used for steel making by using the present apparatus.

In FIG. 4, in order that a stamping material 2 at the lower portion may not be pressed out of a side wall 3 of the electric furnace at the time of filling under vibration, the outside portion of said pressurizing plate 1 is made sector shape to tightly contact the wall, but proportionately to the size of hearth or the place where the stamping material is applied or the hearth is repaired. Said outside portion may be in the sector shape the angle of which is at least 1/15 (24°) of the circumference of the furnace as shown in FIG. 2, or it may further be of a shape in which its central portion was cut off as shown in FIG. 3. Moreover, in the case of using as the pressurizing plate 1 a steel plate thicker than about 30 mm, it will suffice to mount the vibrating mechanisms 9 referred to below directly to said pressurizing plate 1 (see FIGS. 2 and 3) without providing a frame as shown in FIG. 1. In either case, however, the pressurizing area in contact with the stamping material 2 must be in the range from 0.05 to 5.0 $m^2$.

The reason of fixing said range is that with less than 0.5 $m^2$, the range operable at one time is very small thereby requiring frequent transfer of the pressurizing plate 1 and a complicated working not suitable for large-sized electric furnaces. With more than 5.0 $m^2$, it is inconvenient to handle the apparatus within the furnace. Further it is difficult to balance all the vibrators equally when stamping the material by actuating the vibrating mechanisms 9, so that the pressurizing plate 1 sinks non-uniformly to cause a difference of density depending on location. Reference 9 shows vibrating mechanisms. In the vibrating assembly, known rotary vibrators (of 1 mm amplitude and 1,500–3,600 r.p.m. frequency) having imbalanced weight generally are fixed either to the mounting members 8 or directly to the pressurizing plate 1 at intervals between about 400 and about 700 mm. Alternately, known electromagnetic vibrators may be employed.

In the above examples the present apparatus has been applied to an electric furnace and the configuration of said pressurizing plate has been made approximately sector-shape, but no doubt the configuration is not restricted to sector shape and may be made in any optional shape.

The present apparatus will now be described as to how it is operated, with reference to the use example as shown in FIG. 4. Firstly, the furnace cover is turned to be fully opened and the dry, magnesia stamping material 2 is charged onto the lined bricks previously built. The material 2 is levelled in such a way that it becomes 200–300 mm thick. Secondly, the apparatus is set on said material by hoist or the like (not shown) in such a manner that the outside panel 4 closely contacts the side wall 3 and the inside panel 6 is positioned approximately at the center of the hearth. Upon initiating suitable vibrations from the outside of the furnace by remote control 9, the stamping material 2 at the lower portion is pressed by said pressurizing plate 1 thereby to be filled at high density. The pressurizing plate 1 is successively moved toward the arrow direction, and the charging is repeated under vibration 10 to 15 times. Thus, uniformly stamped layers can be formed in a shorter period of time with about $\frac{2}{3}$ of those workers conventionally needed. If thicker layers are desired, it will suffice to repeat the operations of charging the material and filling under vibration onto the previously stamped layers. By repeated application in the thickness (height) direction, it is possible to build any thickness hearth desired as a completely integrated, structural hearth.

EXAMPLE

With regard to a hearth (of 2.6 m radius) of an 80 t electric furnace used for mild steel making, a stamping layer thickness of 40 cm and about 20 t of dry, magnesia stamping material, was produced by using the present apparatus and conventional apparatus respectively. Tests for practical use were then carried out under the same operational conditions.

As a result, it was found that with the present apparatus: the number of workers and the working time were 6 persons×6 hours (with conventional apparatus 14 persons×19 hours), and the endurable life could continue 18 days (14 days with conventional apparatus) before a small repair was needed. Thus, the present invention succeeding in prolonging the life by about 1.3 times.

As described above in detail, the present apparatus makes it possible: to use dry, stamping material of particularly high corrosion resistancy for making hearth; to completely eliminate the stamping work which had conventionally been carried out by many workers within a furnace of much dust; to make the integrated hearth quickly, under vibration, with a small number of workers by remote control from the outside of the furnace; and to greatly prolong the endurable life of the hearth—thereby presenting many excellent effects.

What is claimed is:

1. A method of compacting a layer of dry particulate refractory material over a lining of refractory bricks on a circular hearth of a kiln having an upstanding peripheral wall, comprising the steps of:

providing vibrating-compacting apparatus comprising a sector-shaped pressurizing plate said plate having a surface area of 0.5 to 5 $m^2$ and having an arcuate end, and means for vibrating said plate;

providing a layer of dry, compactable particulate refractory material over said lining of refractory bricks on said circular hearth;

positioning said vibrating-compacting apparatus on said layer, the arcuate end of said sector-shaped pressurizing plate having a radius of curvature substantially the same as that of the peripheral wall of said kiln such that the arcuate end of the sector-shaped pressurizing plate can be positioned in adjacency along its length with said peripheral wall, said pressurizing plate being sized to cover only a minor portion of said circular hearth;

actuating said vibrating means to compact the dry particulate refractory material under said pressurizing plate; and moving said vibrating-compacting apparatus to a new position on said hearth to compact the dry particulate refractory material thereunder to provide a compacted layer of said dry particulate refractory material on said kiln hearth.

2. A method according to claim 1 wherein additional dry particulate refractory material is provided on the compacted layer and wherein the vibrating compacting apparatus is positioned to compact the additional dry particulate refractory material to build up the thickness of said compacted layer.

3. A method according to claim 1 wherein said sector-shaped pressurizing plate has sides having a lenght approximately equal to the radius of said kiln hearth and wherein the vibrating-compacting apparatus is positioned on such layer such that its arcuate end is in adjacency along its length with said peripheral wall.

4. A method according to claim 1 wherein said apparatus further comprises a frame and wherein said vibrating means are mounted on said frame.

5. A method according to claim 1 wherein said vibrating means are mounted directly on said pressurizing plate.

* * * * *